US005725055A

United States Patent [19]

Schirmer et al.

[11] Patent Number: 5,725,055

[45] Date of Patent: Mar. 10, 1998

[54] UNDERGROUND MEASUREMENT AND FLUID SAMPLING APPARATUS

[76] Inventors: Mario Schirmer, 159 University Ave., Apt. 803, Waterloo, Ontario, Canada, N2l 3E8; Georg Teutsch, Silcher Weg 30, 72827 Wanweil; Thomas Ptak, Friedenstr. 7,, 7542 Schomberg 4, both of Germany

[21] Appl. No.: 612,213

[22] Filed: Mar. 7, 1996

[51] Int. Cl.[6] ..... E21B 47/00; E21B 49/08

[52] U.S. Cl. ..... 166/264; 166/187

[58] Field of Search ..... 166/264, 287, 166/162, 252.3, 252.5, 250.02

[56] References Cited

U.S. PATENT DOCUMENTS 3,926,254 12/1975 Evans et al. ..... 166/187 X

OTHER PUBLICATIONS

Andersen, L.J., "Impact of Agricultural Activities on Groundwater", International Symposium IAH, Prague Czechoslovakia 1982, pp. 115–124.

Pickens, J.F. et al., "A multilevel Device for Ground–Water Sampling and Piezometric Monitoring", Ground Water, vol. 16, No. 5, pp. 322–327, Sep.–Oct. 1978.

Teutsch, G. et al., "The In–Line–Packer System: A Modular Multilevel Sampler for Collecting Undisturbed Groundwater Samples", pp. 455–456.

*Primary Examiner*—William P. Neuder

[57] ABSTRACT

A fluid sampling apparatus for use in a hole in the earth having a rigid wall and containing a fluid comprising a flexible tubular member extendable within the hole and inflatable to a diameter effective to urge the tubular member against the rigid wall. At least one fluid pump is in communication with the tubular member and the hole for transferring fluid between the tubular member and the hole whereby the tubular member is inflated as the fluid si transferred from the hole into the tubular member and the tubular member is deflated as the fluid is transferred from the tubular member to the hole. The flexible tubular member may be adapted to contain at least one instrument for sampling and measuring fluids.

29 Claims, 5 Drawing Sheets

UNDERGROUND MEASUREMENT AND FLUID SAMPLING APPARATUS

FIELD OF INVENTION

This invention relates to an underground fluid sampling apparatus and, more particularly, relates to an apparatus for collecting groundwater samples, as well as physical, chemical and geophysical measurements of insitu materials in boreholes.

BACKGROUND OF THE INVENTION

Boreholes are made in the earth to supply water and test various fluids such as water and oil and to take desired geophysical measurements. Samples of groundwater are particularly important for the work of hydrogeologists.

Samples of groundwater can be obtained using piezometers and specially constructed monitoring wells and systems. These procedures involve the drilling and construction of a borehole which is costly and time consuming. Existing uncased or screened boreholes offer a cost-effective option for obtaining fluid samples and, in particular, groundwater samples.

It is well known that any borehole affects the natural groundwater flow in its vicinity. Small hydraulic gradients result in the flow of water within the borehole and representative samples can only be obtained by a large outlay of time and instrumentation, i.e. nested piezometers or multiple tubes within large boreholes. A nonrepresentative sample, especially in contaminated areas, implies the danger of erroneous interpretation of the spatial and temporal contaminant distribution. In addition, contaminant migration through open boreholes into clean aquifer areas is not uncommon.

Underground instrumentation emplacement systems such as that shown in U.S. Pat. No. 5,176,207 which issued Jan. 5, 1993, to Keller have been devised for placing instrumentation within a hole. A tubular member which contains instrumentation is first wound onto a storage reel within a canister which is placed above the hole. The tubular member and instrumentation are inverted when wound onto the storage reel. A pressurizing liquid or gas is introduced into the canister to unwind the tubular member from the storage reel into the hole. This is a relatively expensive apparatus which limits the size of the instrumentation used since it is wound within the canister as the tubular member is removed from the hole.

It is desirable to have an underground fluid sampling apparatus with an inflation/deflation system which allows large size instrumentation to be used. It is also desirable to have an underground fluid sampling apparatus which allows samples to be taken from accurately defined depths.

SUMMARY OF THE INVENTION

The disadvantages of the prior art may be substantially overcome by providing a fluid sampling apparatus which allows samples and measurements of fluids and insitu materials at accurately defined depths and which allows relatively large instrumentation to be used for such sampling and measuring.

In its broad aspect, the fluid sampling apparatus for use in a borehole in the earth which has a rigid wall and contains a fluid comprises a flexible tubular member extendable within the hole and inflatable to a diameter effective to urge the tubular member against the rigid wall. At least one fluid pump is in communication with the tubular member and the hole for transferring fluid between the tubular member and the hole whereby the tubular member is inflated as the fluid is transferred from the hole into the tubular member and the tubular member is deflated as the fluid is transferred from the tubular member to the hole.

In one aspect of the invention, the flexible member is adapted to contain at least one instrument for sampling and measuring fluids.

The underground fluid sampling apparatus allows concurrent groundwater sampling and measurement of physical, chemical and geophysical parameters of insitu material. The apparatus is built for short term or stationary application and can, therefore, be used to obtain groundwater samples and parameters over an arbitrary long time. This is helpful for testing remediation projects and/or sites with fluctuating contaminant concentrations and can yield important economic and scientific conclusions.

An advantage of the apparatus of the invention is that it can be used as a pure groundwater sampling device, a pure measuring device, or as a combination of both. The apparatus may also effectively seal a borehole when placed in a borehole without instruments to limit possible contamination between a contaminated aquifer and another aquifer.

The apparatus of the invention allows geophysical measurements using sensors or other instruments placed within or external to the tubular member or connected to the tubular member. For example, for acoustic and seismic measurements, the sensors can be placed inside the tubular member and groundwater sampling devices can be external to the tubular member.

BRIEF DESCRIPTION OF THE DRAWINGS

The present invention will now be described with reference to the accompanying drawings, in which.

DETAILED DESCRIPTION OF THE PREFERRED EMBODIMENT

Figure 1:
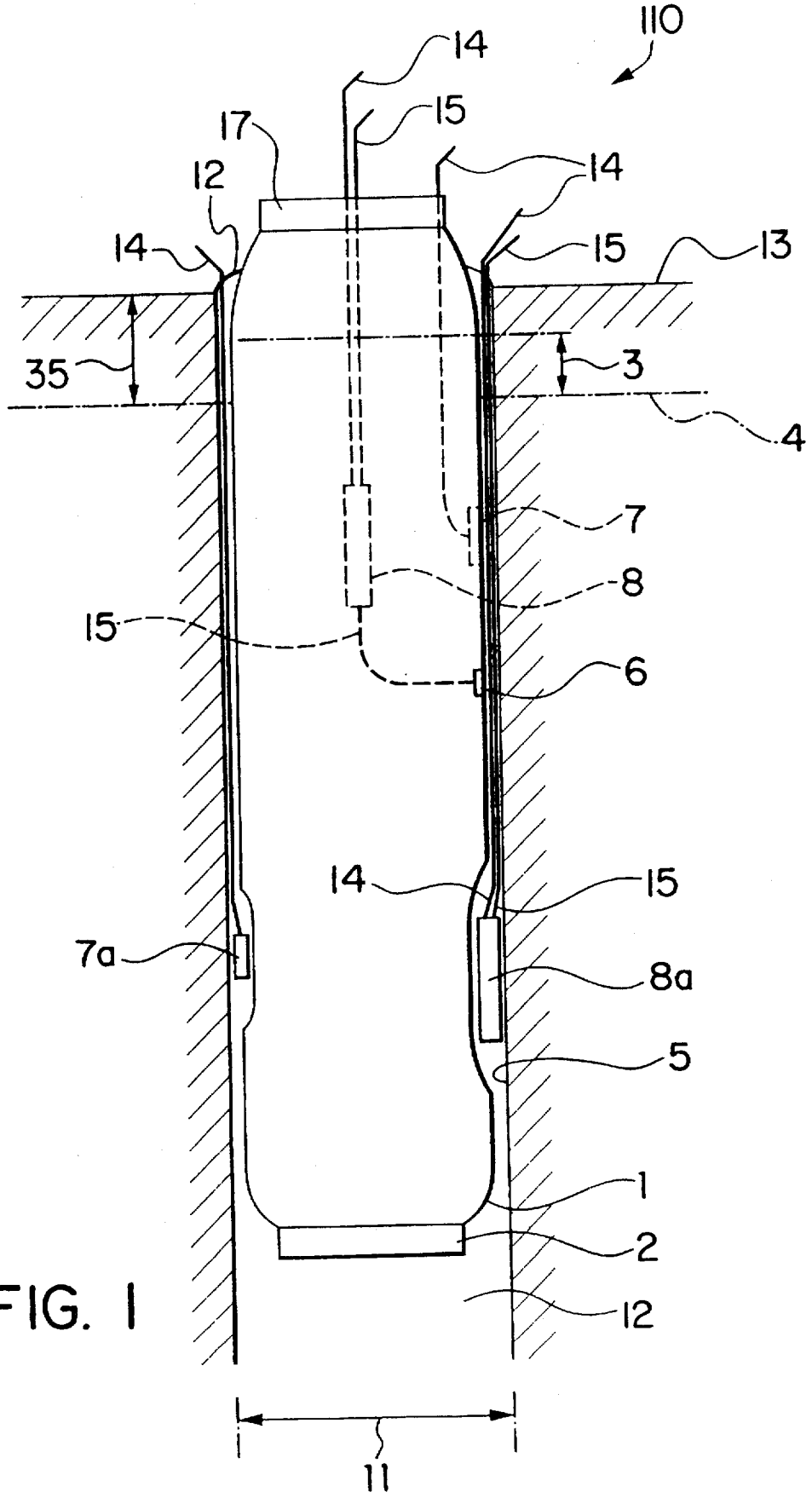
FIG. 1 is a cross-sectional side view of the underground fluid sampling apparatus in inflated position within a borehole.
Figure 2:
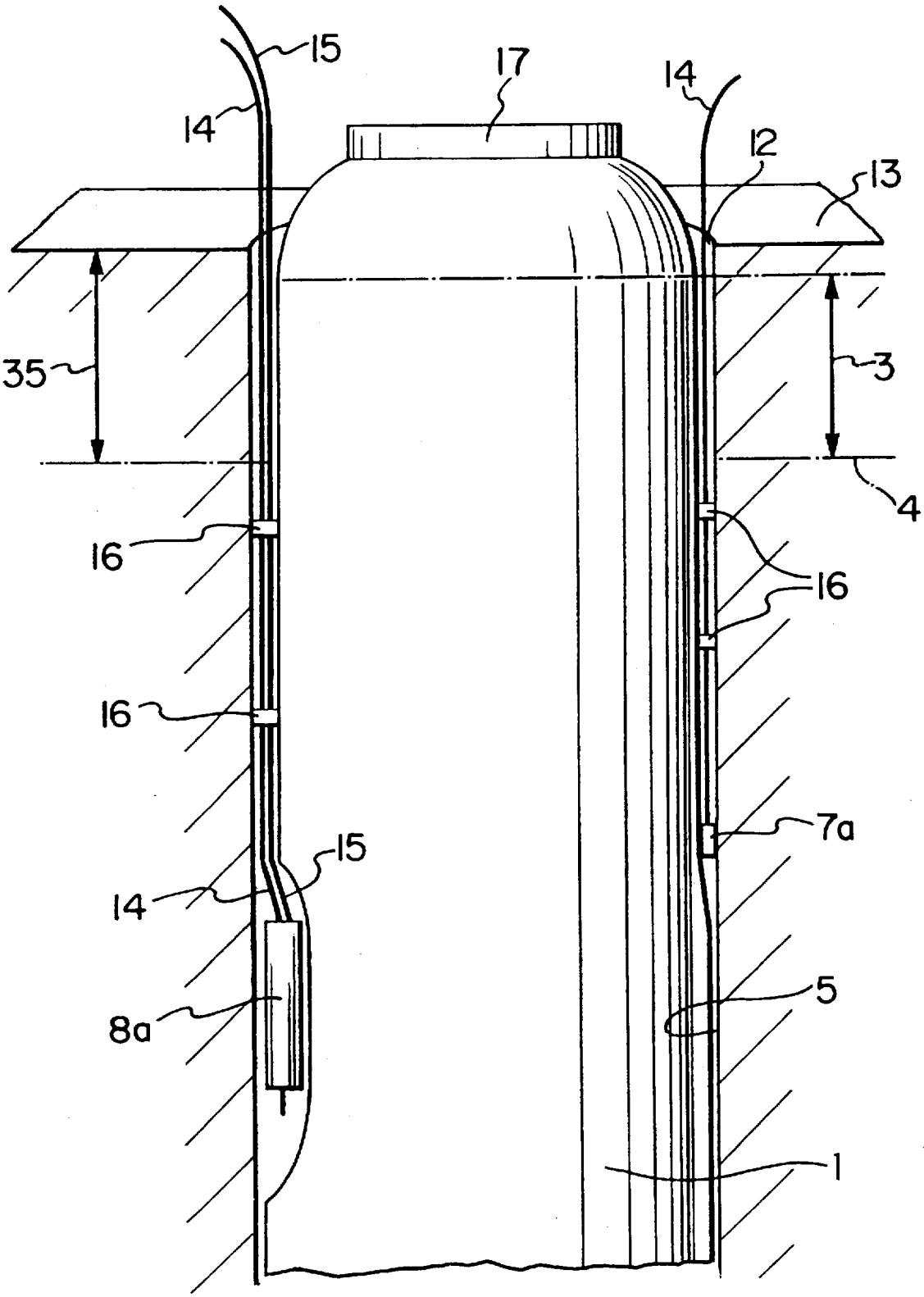
FIG. 2 is a cross-sectional fragmentary side view of the underground fluid sampling apparatus of FIG. 1 within a borehole.

Referring first to FIGS. 1 and 2, the underground fluid sampling apparatus 110 of the invention is shown inflated within a borehole 12. The ground surface is depicted as numeral 13.

The underground fluid sampling apparatus 110 has a flexible tubular member 1 and a bottom element 2 at the lower end of the tubular member 1. The bottom element 2 is preferably brass. Measuring equipment 7, 7*a* and sampling equipment 8, 8*a* can be placed inside 7, 8 and/or outside 7*a*, 8*a* of tubular member 1. The measuring equipment 7, 7*a* and sampling equipment 8, 8*a* allow simultaneous or sequential sampling of groundwater and measurements of insitu materials at different predetermined depths.

The measuring equipment 7, 7*a* and sampling equipment 8, 8*a* used depends upon the desired samples and measurements. Equipment such as a thermocouple, pressure sensing means, means for fluid extraction or absorption, fiber optic sensing means, seismic sensing means, electrical conductivity sensing means and pH sensing means can be used.

The underground fluid sampling apparatus 110 can be used in open boreholes as well as in boreholes with an internal casing. Depending on the size of the sampling 8, 8*a* and measuring equipment 7, 7*a* the underground fluid sampling apparatus 110 can be custom built for borehole diameters.

The underground fluid sampling apparatus 110 is filled using water, compressed air or any other pressurized fluid. An inner pressure higher than the hydrostatic pressure of the surrounding aquifers, e.g., about 0.05 to 0.5 bar above groundwater head, has to be maintained to press the flexible tubular member 1 against the borehole wall 5 and therefore to prevent water circulation inside the borehole 12. This prevents the borehole from acting as a conduit for groundwater flow that may adversely influence the correct assessment of the groundwater hydrogeology and surrounding earth materials.

After the emplacement of the underground fluid sampling apparatus 110 in the borehole 12, a higher pressure inside the underground fluid sampling apparatus 110 with respect to the groundwater level 4 is built up either by addition of an inert gas, air, water or like fluid in order to push the groundwater out of the borehole 12 either into the surrounding earth material or out of the borehole 12 to the ground surface and to urge the underground fluid sampling apparatus 110 against the borehole wall 5, thereby inflating the underground fluid sampling apparatus 110. The underground fluid sampling apparatus 110 is sealed at the lower end using the bottom element 2 to prevent a pressure drop inside the underground fluid sampling apparatus 110 through leakage of any fluid.

If a fluid such as water is used to inflate the underground fluid sampling apparatus 110, the fluid level within the tubular member 1 is above the groundwater level as shown by numeral 3 to provide enough pressure for removal of the groundwater within the borehole. This elevated level of fluid 3 above the groundwater level 4 is referred to as an extra pressure head. This extra pressure head 3 depends on the flexible tubular member 1 material. An extra pressure head 3 of 2–10 feet is usually sufficient for boreholes with small vertical hydraulic gradients. A higher pressure within the flexible tubular member 1 has to be applied for boreholes with larger vertical hydraulic gradients. If the underground fluid sampling apparatus 110 is filled with water, another liquid, a solution or a gel, then the top element 17 at the upper end of the flexible tubular member 1 can be open to atmospheric pressure. If compressed air or another gas is used as the pressurizing fluid, the top element 17 has to be pressure tight to maintain the gas within the underground fluid sampling apparatus and, thus, maintain the tubular member 1 against the borehole wall 5.

If the flexible tubular member 1 consists of an elastic material, the tube diameter can be smaller than the borehole diameter 11, because the flexible tubular member 1 inner pressure will stretch the material and press it against the borehole wall 5. However, in the preferred embodiment, the flexible tubular member 1 is non-elastic material. The flexible tubular member 1 tube diameter is preferably 10% larger than the borehole diameter 11 when the flexible tubular member 1 is non-elastic material. In particular, the tubular member 1 is preferably comprised of non-stretchable material which will sorb or desorb minimal pollutants, such as coated aluminium foil, HYPALON™ (chlorosulphonated polyethylene coated polyamide), thermoplastic polyurethane coated polyester, VITON™ (hexafluoropropene vinylidene fluoride copolymer coated glass fiber), polytetrafluoroethene film, polyethylene, polypropylene, and nylon. In the preferred embodiment, the tubular member 1 is non-stretchable coated aluminium foil.

If the sampling equipment 8 is located inside the flexible tubular member 1, every pump or groundwater collector has to be connected via a sampling tube 15 to an inlet port 6 on the outside of the flexible tubular member 1, so that water from the aquifer can be collected. Measuring equipment 7 inside the flexible tubular member 1 is only useful if no contact to the measured aquifer material is required (e.g. seismic and acoustic measurements). Otherwise, the measuring equipment has to be connected through an opening to the outside of the flexible tubular member 1. The locations of the sampling and measuring points must be defined before the underground fluid sampling apparatus 110 is installed.

If the sampling 8*a* and/or measuring equipment 7*a* are located at the outer side of the flexible tubular member 1 and not connected to the underground fluid sampling apparatus 110, the equipment 7*a*, 8*a* is placed at the desired depths before the flexible tubular member 1 is inflated. The sampling 8*a* and/or measuring equipment 7*a* may be installed first and thereafter the flexible tubular member 1 or vice versa. The sampling and/or measuring depths can be changed if required. The installed flexible tubular member 1 may be deflated, the sampling/measuring depths then adjusted and the flexible tubular member 1 is reinflated again without removal of the underground fluid sampling apparatus 110.

If the sampling 8*a* and measuring equipment 7*a* are connected to the outside of the flexible tubular member 1, the sampling/measuring depths have to be predefined before installation, as is done for the equipment 7, 8 located inside the flexible tubular member 1. The sampling 8*a* and measuring equipment 7*a* at the outside of the flexible tubular member 1 are usually connected to the ground surface 13 using cables 14 and tubes 15. This equipment may create hydraulic conduits for the water in the borehole 12. Hydraulic flow preventers 16 (FIG. 2), such as sponge rings, are attached around all cables 14 and tubes 15 or around the flexible tubular member 1 to prevent such flow of water in the borehole 12. The distance between the flow preventers 16 is chosen depending on the hydraulic gradient in the borehole 12.

Due to the higher pressure inside the underground fluid sampling apparatus 110, the inlet ports 6 for the sampling equipment 8 and measuring equipment 7, as well as the other sampling 8 and measuring equipment 7 are pressed against the borehole wall 5 to provide an exact depth specific water collection and/or measurement. After a groundwater sample has been taken using the underground fluid sampling apparatus 110, some groundwater remains within the underground fluid sampling apparatus 110 and the sampling equipment 8, 8*a* and tubes 15. The groundwater is removed before another groundwater sample can be taken. A representative groundwater sample can usually be obtained with a water volume of $\leqq 1$ gallon.

If groundwater collectors are used which are not connected to units on the ground surface 13, the sample can not be obtained and analyzed unless the underground fluid sampling apparatus 110 is removed from the borehole 12. On the other hand, if a cableless transmission of measured parameters is used, readings can be accomplished at any time.

For a ground surface—groundwater level distance 35 of less than about 15–20 feet, the sampling equipment can be simplified, so that there is only tubes 15 inside the borehole 12. The lower end of the tubes 15 are placed either at the outside of the flexible tubular member 1 underground fluid sampling apparatus 110 or at the inside connected to an inlet port 6 within the flexible tubular member 1. The upper end of the tubes at the ground surface 13 are connected to a pump, such as a peristaltic or a vacuum pump (not shown). If a multi-channel pump is used, several depths can be sampled at the same time.

Samples and measurements can be obtained simultaneously or in any other temporal pattern. A partly or fully automatic use of the underground fluid sampling apparatus 110 is possible utilizing data loggers or automatic samplers within the borehole 12 and/or on the ground surface 13.

If pressurized air or another gas is used to inflate the flexible tubular member 1, the gas is supplied by a compressor or another pressurized gas supply source. If the use of pressurized gas is not desired or appropriate, the flexible tubular member 1 is inflated by the addition of a liquid. This liquid can be either the groundwater from within the borehole 12 using one of the methods described below or by physical addition of a secondary fluid, liquid or gel. A drawback of the use of a secondary fluid or gel is the necessity to supply it to the test site and disposal upon abandonment of the borehole as a sampling/measuring location. For this reason it is preferred to use water from the borehole 12 to inflate the underground fluid sampling apparatus 110 and pump it back into the borehole 12 when the borehole is no longer desired as a sampling/measuring location.

Figure 3:
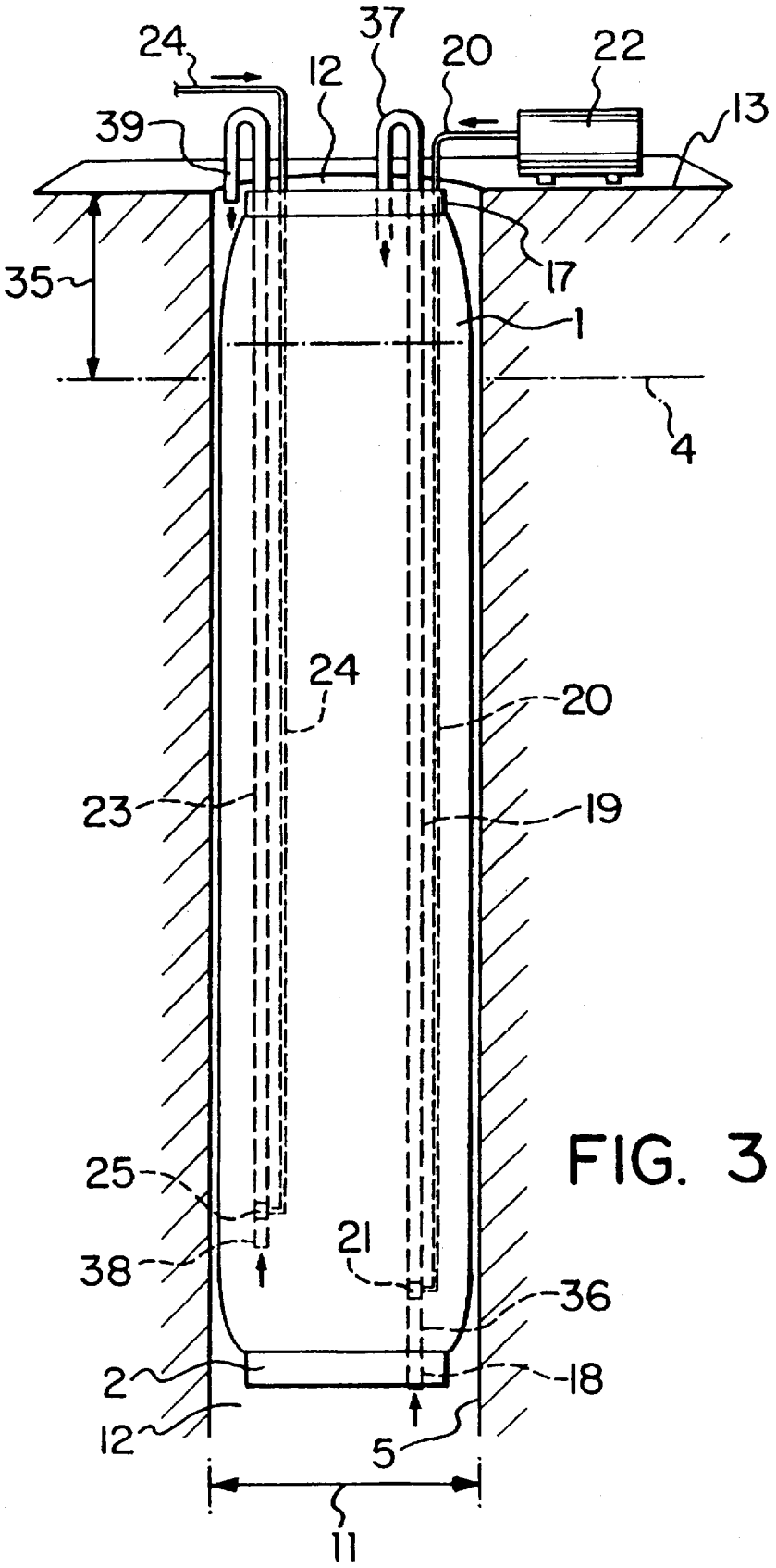
FIG. 3 is a cross-sectional side view of the apparatus of FIG. 1 without sampling and measuring equipment but with an inflation/deflation pump apparatus.

As shown in FIG. 3, a tube 19 is installed inside the underground fluid sampling apparatus 110. The groundwater level—ground surface distance 35 is less than about 15–20 feet. One end 36 of the tube 19 is connected to an opening 18 in the bottom element 2 of the flexible tubular member 1 and the other end 37 reaches the ground surface 13. To inflate the fluid sampling apparatus 110, the tube 19 can be connected to, for example, a peristaltic or vacuum pump (not shown). The water in the borehole 12 beneath the bottom element 2 is pumped from the borehole 12 into the fluid sampling apparatus 110 through tube 19 until the fluid level reaches the desired extra pressure head 3. A second tube 23 is installed so that an end 38 is placed a few inches above the bottom element 2 and the other end 39 reaches the ground surface 13. To deflate the underground fluid sampling apparatus 110 after application, the tube 23 is connected to the pump or a separate pump and the collected water is pumped back into the borehole 12.

Figure 4:
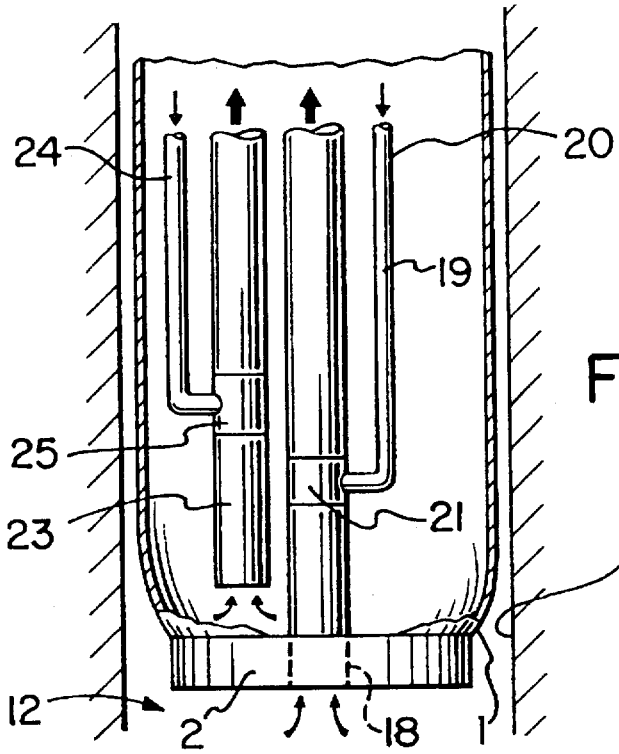
FIG. 4 is a fragmentary cross-sectional side view of the apparatus of FIG. 3.

If the groundwater level—ground surface distance 35 is larger than about 15–20 feet, tubes 19 and 23 are connected to additional tubes 20, 24 using joint connectors 21, 25 as shown in FIGS. 3 and 4. Tube 20 is the pressure inflation tube for tube 19, whereas tube 24 is the pressure deflation tube for tube 23. The joint connectors 21, 25 are placed approximately 5–10 inches above the bottom ends of the inflation and deflation tubes 19, 23, respectively.

The underground fluid sampling apparatus 110 is inflated using the apparatus shown in FIGS. 3 and 4 by supplying compressed air using a compressor 22 or other compressed gas source located at the ground surface 13 through the pressure inflation tube 20 into the inflation tube 19. This technique is commonly known as air-lift pumping and the water-air mixture lifted is immediately used to fill the underground fluid sampling apparatus 110 until the required extra pressure head 3 is obtained.

To deflate the apparatus 110, pressurized air is supplied through the pressure deflation tube 24 to the deflation tube 23. The collected water comes entirely from the inside of the underground fluid sampling apparatus 110 and is pumped to the outside back into the borehole as shown in FIG. 3. No waste water treatment is required.

Figure 5:
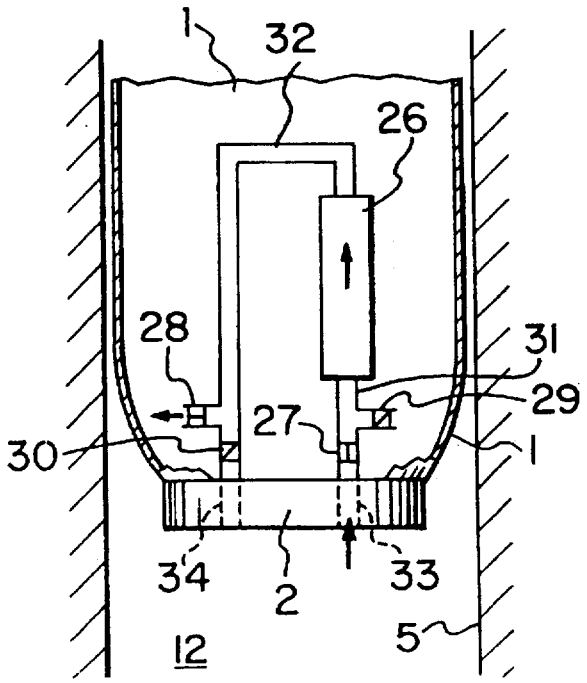
FIG. 5 is a fragmentary cross-sectional side view of a second embodiment of an inflation/deflation pump apparatus in inflation position.
Figure 6:
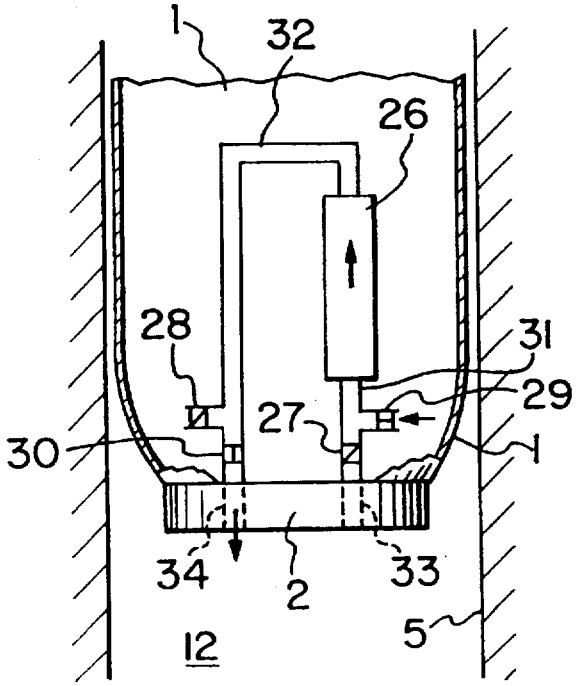
FIG. 6 is a fragmentary cross-sectional side view of the inflation/deflation pump of FIG. 5 in deflation position.

FIGS. 5 and 6 show another embodiment of the invention. A single one-way pump 26 is used as a combined inflation and deflation pump. The suction side 31 and pressure side 32 of the inflation/deflation pump 26 is hydraulically connected to the borehole 12 through openings 33, 34 in the bottom element 2. During the inflation process (FIG. 5), the valves 27 and 28 are open and allow the borehole water be pumped through an opening 33 and through valve 28 into the underground fluid sampling apparatus 110. The valves 29 and 30 are closed.

To deflate the underground fluid sampling apparatus 110, the valves 29 and 30 are open, while valves 27 and 28 are closed (FIG. 6). The water from the inside of the underground fluid sampling apparatus 110 is then pumped through opening 34 in the bottom element 2 back into the borehole 12.

The flexible tubular member 1 of the underground fluid sampling apparatus 110 can be constructed using either single tubes of membrane or multiple membrane tubes welded together. If the underground fluid sampling apparatus 110 is used in highly contaminated areas, inert semi-elastic membranes, such as polytetrafluroethene or polyethylene coated materials, are preferred since elastic materials which are rubber based have usually an unfavourable sorption behaviour.

If the flexible tubular member 1 has a leak, it results in a pressure loss rendering the underground fluid sampling apparatus 110 useless. To avoid that, a bentonite-water emulsion (bentonite mud) commonly used by well drillers to stabilize boreholes during the drilling process, can be pumped into the underground fluid sampling apparatus 110. The emulsion serves as a gel inside the underground fluid sampling apparatus 110 which presses the flexible tubular member 1 against the borehole wall 5. If at some point the underground fluid sampling apparatus 110 leaks and the emulsion flows out of the underground fluid sampling apparatus 110 through the leak into the borehole casing or directly into the formation, the lost emulsion outside the underground fluid sampling apparatus 110 builds a so-called "filter cake" around the location of the leak and, therefore, prevents an additional loss of emulsion while maintaining the flexible tubular member 1 inner pressure. Since the emulsion is a fluid, it can be pumped out of the underground fluid sampling apparatus 110 to deflate and remove the flexible tubular member 1.

The fluid sampling apparatus 110 can also effectively seal a borehole when placed in a borehole without sampling 8 and measuring equipment 7. This serves to limit possible contamination between a contaminated aquifer and another aquifer.

Figure 7:
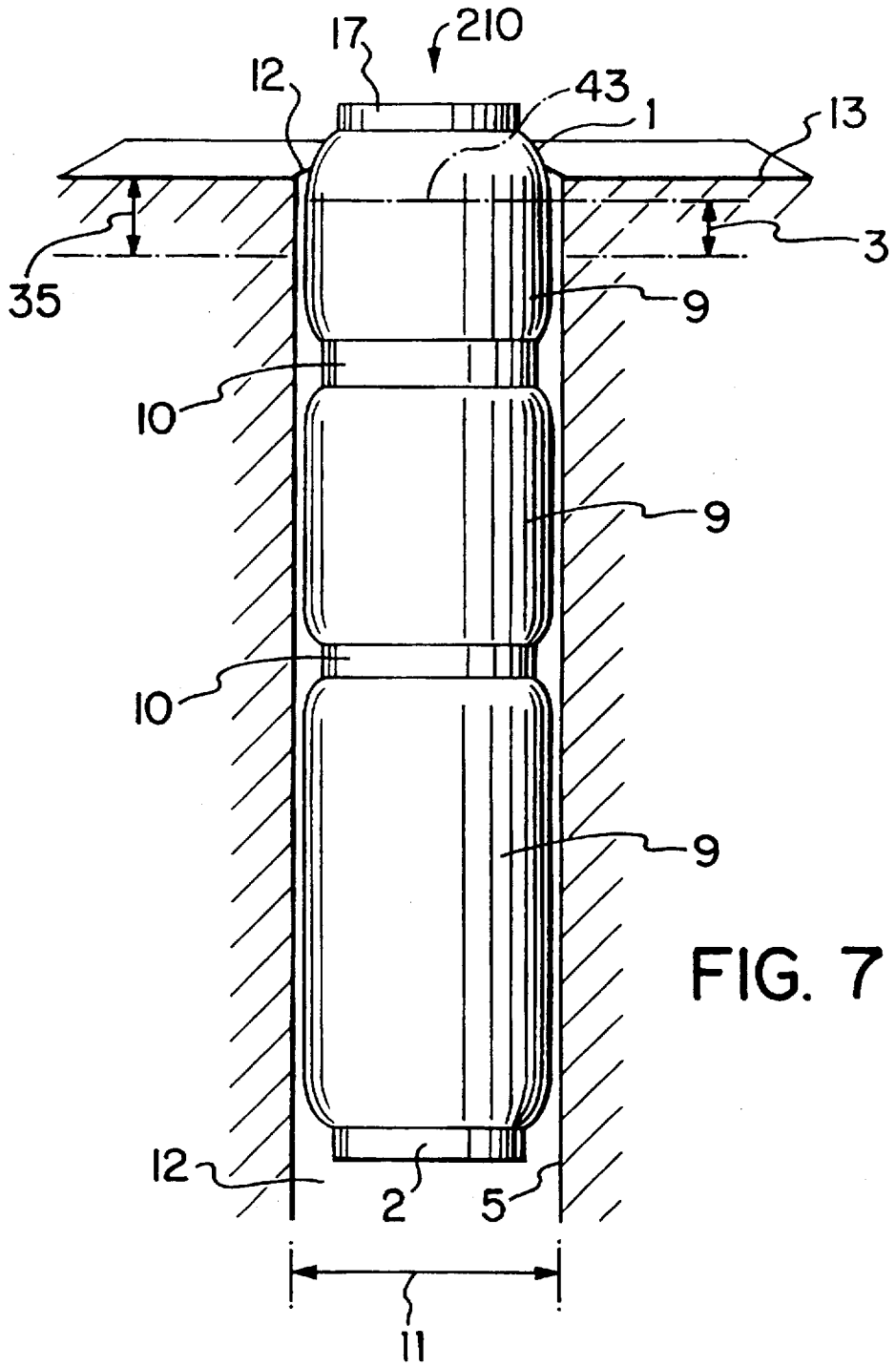
FIG. 7 is a cross-sectional side view of a second embodiment of the underground fluid sampling apparatus of the present invention with a borehole.

FIG. 7 shows a second embodiment of the underground fluid sampling apparatus 210 of the invention within a borehole 12.

The underground fluid sampling apparatus 210 has a modular construction. The flexible tubular member 1 comprises a plurality of modules 9 which are disposed above each other and a bottom element 2. Modular connection joints 10 connect the modules 9 to each other in a pressure tight arrangement. Such apparatus are particularly advantageous for use in boreholes with changing borehole diameter. In such cases, two or more flexible tubular member modules 9 with possibly different flexible tubular member diameters are connected. The underground fluid sampling apparatus 210 can have a cap 17 to maintain gas within the apparatus 210.

The underground fluid sampling apparatus 210 is within borehole 12. The borehole has a diameter depicted as numeral 11. The ground surface is again depicted as numeral 13. Numeral 35 shows the difference between the ground surface and the groundwater level. The level of the fluid within the underground fluid sampling apparatus 210 is depicted by numeral 43 and the extra pressure head is depicted as numeral 3. The underground fluid sampling apparatus 210 may be inflated and deflated using tubes and pumps as described above.

It will be understood, of course, that modifications can be made in the embodiments of the invention described herein without departing from the scope and preview of the invention as described by the appended claims.

We claim:

1. A measurement and fluid sampling apparatus for use in a borehole in the earth having a rigid wall, said apparatus comprising:

(a) a flexible tubular member for placement within said borehole, said member having an interior surface, an exterior surface, a proximal end and a distal end;

(b) means for inflating said tubular member such that said inflation urges said exterior surface into contact with said rigid wall of said borehole;

(c) means for deflating said tubular member;

(d) means for sampling fluid contained from said borehole; and (e) means for measurement in said borehole wherein said means for measurement is selected from the group consisting of a thermocouple, pressure sensing means, means for fluid extraction or absorption from said wall, fiber optic sensing means, seismic sensing means, electrical conductivity sensing means and pH sensing means.

2. The apparatus of claim 1 which includes a means for sealing said tubular member.

3. The apparatus of claim 1 wherein said flexible tubular member comprises a plurality of modular units.

4. The apparatus of claim 1 wherein said means for inflating uses a fluid which is selected from the group consisting of water, pressurized air, fluid from said borehole water, pressurized fluid, or bentonite-water emoltion.

5. The apparatus of claim 1 wherein said means for sampling and said means for measurement are exterior to said member.

6. The apparatus of claim 1 wherein said means for sampling and said means for measurement are inside said member.

7. The apparatus of claim 1 wherein said means for sampling is inside said member.

8. The apparatus of claim 1 wherein said means for measurement is inside said member.

9. The apparatus of claim 1 which includes hydraulic flow prevention means operatively associated with said sampling means and said measurement means.

10. The apparatus of claim 5 which includes hydraulic flow prevention means operatively associated with said external measurement means.

11. The apparatus of claim 5 which includes hydraulic flow prevention means operatively associated with said external sampling means.

12. The apparatus of claim 1 wherein said tubular member is comprised of an elastic material.

13. The apparatus of claim 1 wherein said borehole has different diameters throughout the depth of said borehole and at least one of said modular units has a diameter corresponding to each diameter of said borehole.

14. The apparatus of claim 1 wherein said means for inflating and deflating said tubular member comprises:

(a) a first tube having an interior and exterior, a first end connected to an opening in said proximal end and a second end connected to said distal end such that there is communication between the fluid in said borehole and the interior of said first tube, said first end of said first tube positioned to communicate with said interior of said tubular member;

(b) pumping means operatively connected to said first tube, said pumping means to pump fluid from said borehole up said first tube out said first end of said first tube into said tubular member;

(c) a second tube having an interior and exterior, a first end connected to an opening in said proximal end and a second end disposed inside said tubular member proximal to said distal end, said first end of said second tube positioned to communicate with said exterior of said tubular member into said borehole; and (d) pumping means operatively connected to said second tube, said pumping means to pump fluid from said interior of said tubular member up said second tube out said first end of said second tube and out of said tubular member into said borehole.

15. The apparatus of claim 1 wherein said means for inflating and deflating said tubular member comprises:

(a) at least one, one-way pumping means, operatively connected to a first connector, said connector communicating with the exterior of said tubular member, said connector containing at least two valves ("a" and "b");

(b) said pumping means operatively connected to a second connector, said second connector also communicating with the exterior of said tubular member, said second connector containing at least two valves ("c" and "d");

all of which is arranged such that when valve "a" is open and valve "b" is closed, valve "c" is open and valve "d" is closed, said pumping means fills said tubular member with fluid from the exterior of said tubular member and, when said valve "b" is open, valve "a" is closed, valve "c" is closed and valve "d" is open, said pumping means causes said fluid contained in the said tubular member to exit said tubular member.

16. A measurement and fluid sampling apparatus for use in a borehole in the earth having a rigid wall, said apparatus comprising:

(a) a non-elastic tubular member for placement within said borehole, said tubular member having longitudinal walls, an interior surface, an exterior surface, a proximal end, a distal end, and having a diameter approximately 10% greater than the diameter of said borehole;

(b) means for filling said tubular member;

(c) means for emptying said tubular member;

(d) means for sampling fluid contained in said borehole; and (e) means for measurement in said borehole wherein said means for measurement is selected from the group consisting of a thermocouple, pressure sensing means, means for fluid extraction or absorption from said wall, fiber optic sensing means, seismic sensing means, electrical conductivity sensing means and pH sensing means.

17. The apparatus of claim 16 which includes a means for sealing said tubular member.

18. The apparatus of claim 16 wherein said flexible tubular member comprises a plurality of modular units.

19. The apparatus of claim 16 wherein said means for filling uses a fluid selected from the group consisting of water, pressurized air, fluid from said borehole water, a pressurized fluid, or bentonite-water emoltion.

20. The apparatus of claim 16 wherein said means for sampling and said means for measurement are exterior to said member.

21. The apparatus of claim 16 wherein said means for sampling and said means for measurement are inside said member.

22. The apparatus of claim 16 wherein said means for sampling is inside said member.

23. The apparatus of claim 16 wherein said means for measurement is inside said member.

24. The apparatus of claim 16 which includes hydraulic flow prevention means operatively associated with said sampling means and said measurement means.

25. The apparatus of claim 20 which includes hydraulic flow prevention means operatively associated with said external measurement means.

26. The apparatus of claim 16 wherein said non-elastic tubular member is comprised of a material selected from the group consisting of coated aluminum foil, chlorosulphonated polyethylene coated polyamide, thermoplastic polyurethane coated polyester, hexafluoropropene vinylidene fluoride copolymer coated glass fiber, polytetrafluoroethene film, polyethylene, polypropylene and nylon.

27. The apparatus of claim 16 wherein said borehole has different diameters throughout the depth of said borehole and at least one of said modular units has a diameter corresponding to each diameter of said borehole.

28. The apparatus of claim 16 where said means for filling and emptying said tubular member comprises:

(a) a first tube having an interior and exterior, a first end connected to an opening in said proximal end and a second end connected to said distal end such that there is communication between the fluid in said borehole and the interior of said first tube, said first end of said first tube positioned to communicate with said interior of said tubular member;

(b) pumping means operatively connected to said first tube said pumping means to pump fluid from said borehole up said first tube and out said first end of said first tube into said tubular member;

(c) a second tube having an interior and exterior, a first end connected to an opening in said proximal end and a second end disposed inside said member proximal to said distal end, said first end of said second tube disposed to communicate with said exterior of said member into said borehole;

(d) pumping means operatively connected to said second tube, said pumping means to pump fluid from said interior of said tubular member up said second tube out said first end of said second tube and out of said tubular member into said borehole.

29. The apparatus of claim 16 wherein said means for filling and emptying said member comprises:

(a) at least one, one-way pumping means, operatively connected to a first connector, said connector communicating with the exterior of said member said connector containing at least two valves ("a" and "b");

(b) said pumping means operatively connected to a second connector, said second connector also communicating with the exterior of said member and said second connector containing at least two valves ("c" and "d");

all of which is arranged such that when valve "a" is open and valve "b" is closed, valve "c" is open and valve "d" is closed, said pumping means fills said member with fluid from the exterior of said member and, when said valve "b" is open, valve "a" is closed, valve "c" is closed and valve "d" is open, said pumping means causes said fluid contained in the said member to exit said member.

* * * * *

UNITED STATES PATENT AND TRADEMARK OFFICE

CERTIFICATE OF CORRECTION

PATENT NO. : 5,725,055

DATED : March 10, 1998

INVENTOR(S) : Mario Schirmer, Georg Teutsch, Thomas Ptak

It is certified that error appears in the above-indentified patent and that said Letters Patent is hereby corrected as shown below:

On the title page, item [76], should read as follows:

-- Mario Schirmer, 159 University Ave., Apt. 803, Waterloo, Ontario, Canada, N2L 3E8; Georg Teutsch, Silcher Weg 30, 72827 Wannweil; Thomas Ptak, Friedenstr. 7, 7542 Schomberg 4, both of Germany --.

In the Abstract, line 8, "si" should be -- is --.

Signed and Sealed this

Twenty-seventh Day of October, 1998

*Attest:*

Bruce Lehman

BRUCE LEHMAN

*Attesting Officer*

*Commissioner of Patents and Trademarks*